US007581486B2

(12) United States Patent
Grieser

(10) Patent No.: US 7,581,486 B2
(45) Date of Patent: Sep. 1, 2009

(54) HYDRAULIC SYSTEM

(75) Inventor: Wolfram Grieser, Riemerling (DE)

(73) Assignee: Eurocopter Deutschland GmbH, Donauwoerth (DE)

( * ) Notice: Subject to any disclaimer, the term of this patent is extended or adjusted under 35 U.S.C. 154(b) by 265 days.

(21) Appl. No.: 11/624,597

(22) Filed: Jan. 18, 2007

(65) Prior Publication Data

US 2007/0163251 A1 Jul. 19, 2007

(30) Foreign Application Priority Data

Jan. 18, 2006 (DE) ..... 10 2006 002 566

(51) Int. Cl.
*F15B 1/02* (2006.01)
*F15B 15/00* (2006.01)

(52) U.S. Cl. ..... 91/415; 60/413; 91/509; 91/417 R

(58) Field of Classification Search ..... 60/413, 60/592, 416; 91/415, 417 R, 509, 535; 92/143
See application file for complete search history.

(56) References Cited

U.S. PATENT DOCUMENTS

| | | | | |
|---|---|---|---|---|
| 3,295,420 | A * | 1/1967 | Gleason et. al. | 91/509 |
| 5,050,380 | A * | 9/1991 | Jonsson | 91/417 R |
| 6,095,028 | A * | 8/2000 | Lamås et al. | 91/417 R |

FOREIGN PATENT DOCUMENTS

| | | |
|---|---|---|
| AT | 401 552 | 10/1996 |
| DE | 100 06 13 | 1/1957 |
| DE | 10006013 | 8/2001 |
| EP | 1 176 314 | 1/2002 |

* cited by examiner

*Primary Examiner*—Thomas E Lazo
(74) *Attorney, Agent, or Firm*—Darby & Darby

(57) ABSTRACT

A hydraulic system includes a reservoir for a hydraulic fluid, a pump, a high-pressure line network, a low-pressure line network and operating cylinders each of which can be connected to the high-pressure line network or to the low-pressure line network via control units, each operating cylinder is associated with a local compensation volume element.

14 Claims, 3 Drawing Sheets

HYDRAULIC SYSTEM

Priority is claimed to German Patent Application No. DE 10 2006 002 566.0, filed on Jan. 18, 2006, the entire disclosure of which is incorporated by reference herein.

The present invention relates to a hydraulic system comprising a reservoir for the hydraulic fluid, a pump, a high-pressure line network, a low-pressure line network and operating cylinders, each of which can be connected to the high-pressure line network or low-pressure line network via control units.

BACKGROUND

Normally, the operating cylinders of such hydraulic systems are at least partially configured in such a way that the volumes displaced by the working strokes on the high-pressure side of the operating cylinder are not equal to those on the low-pressure side. Therefore, the differential volume has to be compensated for which, in prior-art hydraulic systems, is done in that the reservoir that is needed anyway to compensate for losses due to leakage and to compensate for temperature-related volume fluctuations is dimensioned to be so large that it can accommodate these differential volumes as well. If a hydraulic system has several operating cylinders that can be actuated independently of each other, then the reservoir volume that needs to be made available can be quite considerable since the size of the reservoir has to be dimensioned taking into account the sum of all differential volumes, temperature-related fluctuations and margins for leakage. An additional problem arises if the hydraulic systems require several redundant hydraulic circuits, as is the case in aircraft construction due to safety considerations. In order to allow the use of identically designed reservoirs, the hydraulic circuit with the largest fluctuation range is the determining factor for the dimensioning of all of the reservoirs. This results in at times substantial additional requirements in terms of the reservoir volume as well as the amount of fluid for the entire system which, in turn, translates into the severe drawback that a large weight has to be carried by the aircraft.

Austrian patent application AT 401 552 B discloses a device to hold and subsequently release hydraulic fluid from a hydraulic system. This device has an operating cylinder and a feed line located between a pump and the operating cylinder so that hydraulic fluid can be fed in at high pressure at a predefined interval. Moreover, the device comprises a holding cylinder with a piston that, on one side, delimits a fluid space to hold hydraulic fluid from the operating cylinder at a discharge pressure that is considerably lower than the high pressure whereby, on the other side, the piston forms a chamber that contains gas under a low pressure and has a high-pressure cylinder with a fluid space in which a plunger piston moves, whereby the fluid space is connected to the feed line for purposes of holding and releasing hydraulic fluid at high pressure. A piston rod is arranged between the plunger piston and the piston in order to transmit movements from the plunger piston to the piston and vice versa. Furthermore, the area of the piston that is affected by the pressure of the hydraulic fluid is considerably larger than the area of the plunger piston that is influenced by the pressure of the hydraulic fluid.

SUMMARY OF THE INVENTION

An object of the present invention is to configure a hydraulic system of the above-mentioned type in such a manner that the central reservoir volumes that need to be made available can be minimized to such an extent that they only need to be sufficiently dimensioned to compensate for losses due to leakage and for temperature-related fluctuations, as a result of which both the physical size and the weight can be reduced.

The present invention provides a hydraulic system having a reservoir for hydraulic fluid, a pump, a high-pressure line network, a low-pressure line network and operating cylinders, each of which can be connected to the high-pressure line network or to the low-pressure line network via control units, at least one of the operating cylinders, but preferably each operating cylinder (insofar as the operating cylinder does not have already the same volume anyway), is associated with a local compensation volume element that is adapted in such a way that it compensates for the differential volume between the high-pressure side and the low-pressure side of the operating cylinder. Therefore, for each operating cylinder and in a manner adapted precisely to its geometry, the differential volume resulting from a stroke movement of the operating piston is added to the compensation volume element or else removed from the compensation volume element and added to the operating cylinder, so that there is no need to make use of the volume of the central reservoir.

As a result, the central reservoir for the hydraulic fluid of the hydraulic system can be considerably reduced. In the case of redundant, additional circuits, compensation volume elements only have to be provided in those areas and in those sizes where this is required for reasons of redundancy and it is not necessary to provide an extremely large reservoir volume arising from the addition of all of the differential volumes. Therefore, when it comes to new hydraulic systems, a substantial amount of installation space and weight can be saved in comparison to conventional systems. In existing systems, the operating cylinders can be locally enlarged with local compensation volume elements without any problem, thus avoiding the need to alter or replace an existing central reservoir volume.

The local compensation volume element preferably has a compensation space as well as an operating element, for instance, in the form of an operating piston, that is arranged movably in the compensation space.

In another embodiment of the invention, it is provided that one or several operating cylinders have a pressure accumulator whose useful piston displacement, as is generally known, is considerably greater than the piston displacement of an operating cylinder, and that the operating cylinder and the pressure accumulator are provided with a compensation volume element configured as a shared compensation volume element which is adapted in such a way that it can accommodate the differential volumes from the operating cylinders and from the pressure accumulator. This solution is very advantageous in terms of the design effort it involves since, when pressure accumulators of buffered operating cylinders are used, the total compensation volume of the pressure accumulator and of one or more operating cylinders only differs slightly, if at all, from the compensation volume of the pressure accumulator alone. In contrast, the entire compensation volume of a pressure accumulator which is used to supply several operating cylinders is relatively large and, as long as this compensation volume does not have to be accommodated by the central reservoir, this entails a significant advantage over conventional systems.

An advantageous embodiment of the invention is one in which, in order to accommodate or release the differential volume, the compensation volume element is actuated by means of a mechanical connection to the operating piston of the operating cylinder or of the pressure accumulator. Such a direct mechanical connection can be constructed very easily and entails the advantage that the dimensions of the compensation volume element can be precisely and easily adapted to the size of the differential volume, and thus does not have to be selected any larger than absolutely necessary.

In an embodiment of the invention, it is advantageous if the mechanical connection is an elongated piston rod that extends from the operating cylinder or pressure accumulator and that is connected to the operating piston of the compensation volume element. This simple design, once again, saves both construction effort and weight. Here, it is particularly advantageous if, as is proposed in another refinement of the invention, the compensation volume element is arranged coaxially with the operating cylinder with which it cooperates.

BRIEF DESCRIPTION OF THE DRAWINGS

Embodiments of the invention will be described below making reference to the accompanying drawings. The drawings show the following.

DETAILED DESCRIPTION

Figure 3:
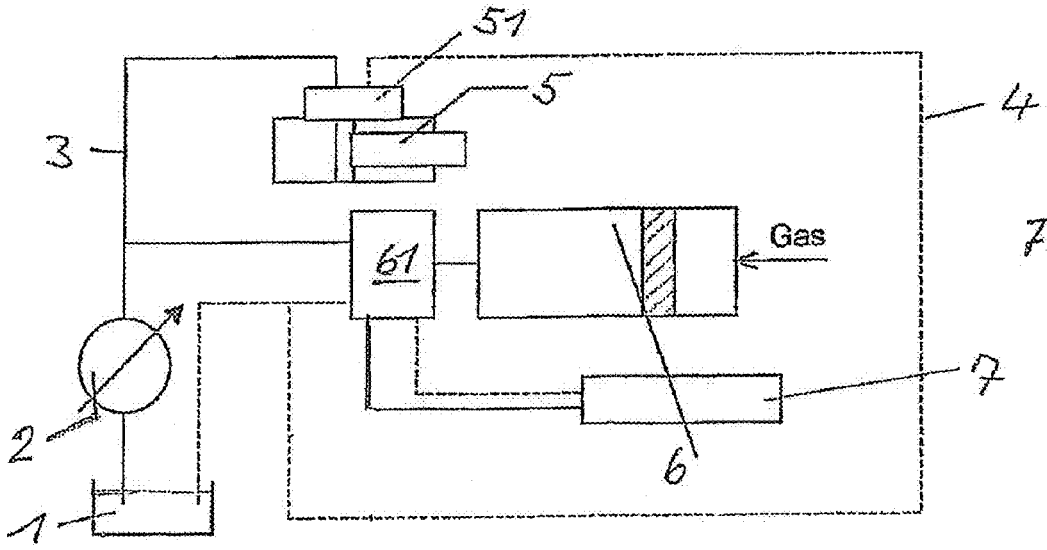
Fig 3 Prior Art
FIG. 3—a conventional hydraulic system according to the state of the art.

In the conventional hydraulic system as shown in FIG. 3, hydraulic fluid is pumped from a reservoir 1 by means of a pump 2 into a high-pressure line network 3. A low-pressure line network 4 leads back to the central reservoir 1. A first operating cylinder 5 is connected to the high-pressure line network 3 and to the low-pressure line network 4 via a first control unit 51. A second operating cylinder 7 is connected to a piston pressure accumulator 6 via a second control unit 61, said second operating cylinder 7 being charged with pressure from the piston pressure accumulator 6. A low-pressure line leads from the second operating cylinder 7 via the second control unit 61 back to the low-pressure line network 4 and to the central reservoir 1. The piston pressure accumulator 6 is charged with compressed gas in order to provide a constant pressure level. As can be seen in the schematic longitudinal section of the operating cylinder 5, the volumes displaced by the operating stroke are not the same on the high-pressure side and on the low-pressure side. In the case of the prior-art hydraulic system shown, it has to be possible to accommodate the differential volume by dimensioning the reservoir 1 correspondingly large. The reservoir 1 has to be dimensioned so large that it can accommodate the differential volumes from the operating cylinder 5, from the second operating cylinder 7 or from the pressure accumulator 6 when the operating cylinder 5 and the second operating cylinder 7 are controlled independently of each other.

Figure 1:
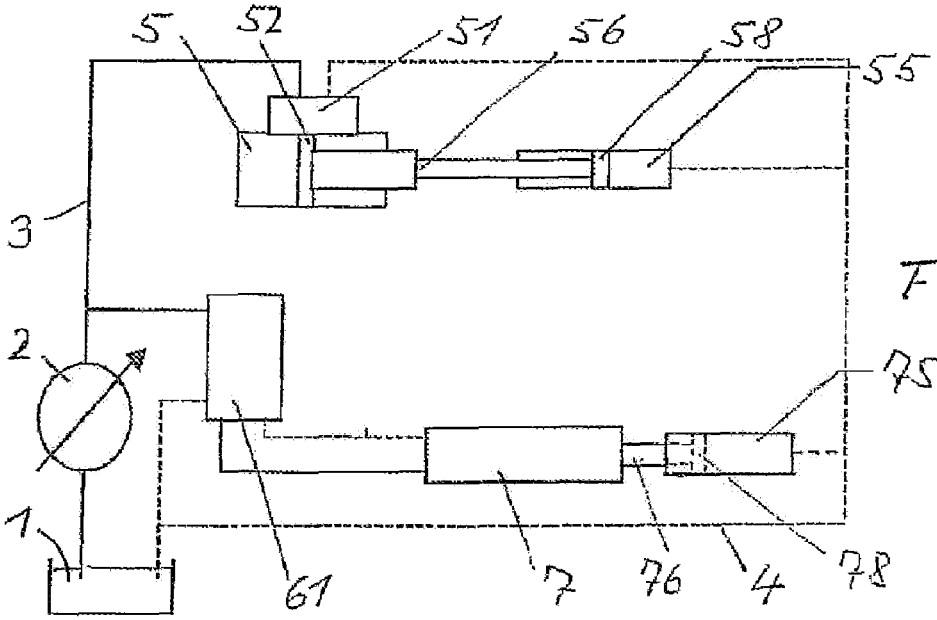
FIG. 1—a first fundamental embodiment of a hydraulic system according to the invention, with two operating cylinders.

In the fundamental embodiment of a hydraulic system according to the invention as shown in FIG. 1, its individual components are designated with analogous reference numerals as in the case of the prior-art hydraulic system shown in FIG. 3. The operating cylinder 5 is configured in the same manner as the arrangement show in FIG. 1. A local, first compensation volume element 55 connected on one side to the low-pressure line network 4 is associated with the operating cylinder 5 in such a way that the first compensation volume element 55 is arranged coaxially with the operating cylinder 5 and an elongated piston rod 56 extending from the operating cylinder 5 is connected to the operating piston 58 of the first compensation volume element 55. Therefore, the piston rod 56 concurrently constitutes a piston rod of the operating piston 58. This extremely simple design means that the differential volume between the high-pressure side and the low-pressure side of the operating cylinder 5 is accommodated in the compensation volume element 55 and is thus separated from the central reservoir 1. In the same manner as the first compensation volume element 55 for the operating cylinder 5, a second compensation volume element 75, likewise connected on one side to the low-pressure line network, acts upon a second operating cylinder 7 whereby, in this case, the piston rod 76 of the second operating cylinder 7 is connected to the operating piston 78 of the second compensation volume element 75. Thus, the piston rod 76 concurrently constitutes a piston rod of the operating piston 78.

Figure 2:
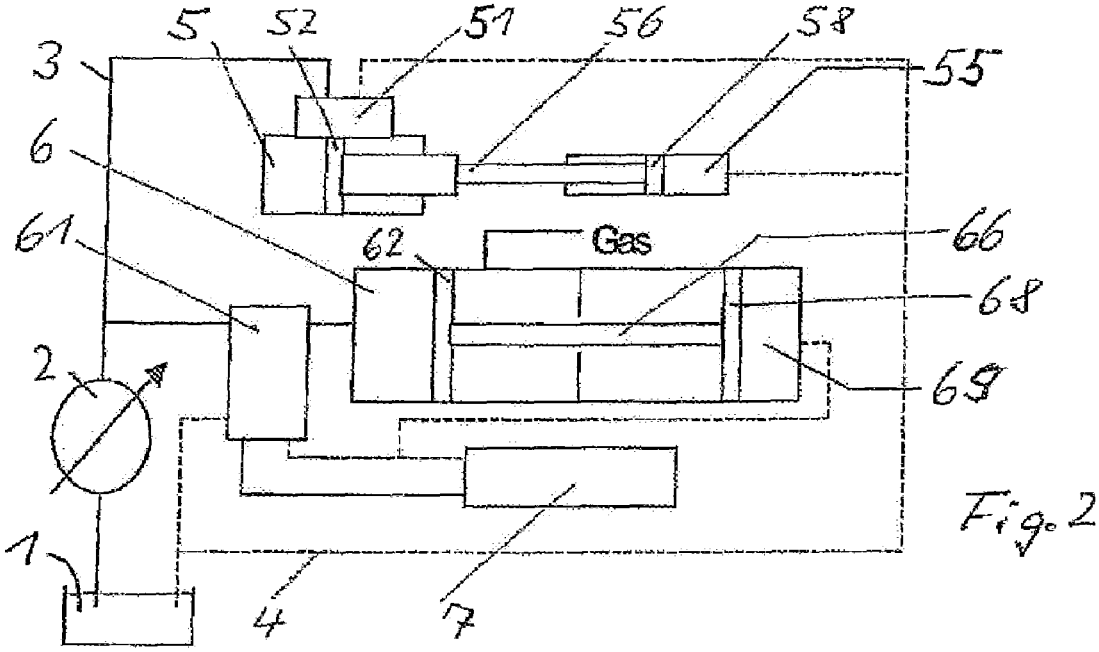
FIG. 2—a hydraulic system as shown in FIG. 1, except with the modification that a pressure accumulator is provided for one operating cylinder.

In the second embodiment of a hydraulic system according to the invention shown in FIG. 2, the second operating cylinder 7 is charged with pressure from a pressure accumulator 6. This pressure accumulator has a piston rod 66 with a first and second operating piston 62, 68. As can be seen in the drawing, the useful piston displacement of the pressure accumulator 6 should be considerably greater than the piston displacement of the operating cylinder 7. As a result, the second operating cylinder 7, without utilizing the pump 2, can execute several cycles or run for a prolonged operating time without stressing the pump 2. The pressure accumulator 6 is charged with compressed gas, which is indicated by the designation "Gas" in FIG. 2. For the second operating cylinder 7 and for the pressure accumulator 6 that cooperates with it, a shared compensation volume element 69 is provided that is adapted in such a manner that it can accommodate the differential volumes from the operating cylinder 7 and from the pressure accumulator 6. The shared compensation volume element 69, in turn, is configured in such a way that it is arranged coaxially with the pressure accumulator 6 or forms at least partially a component or partial area thereof and, on the right-hand side of the second operating cylinder 68 in FIG. 2, elongates the operating space of the pressure accumulator 6 that is available to the piston rod 66 and to the second operating piston 68. Here, the second operating piston 68 of the pressure accumulator 6 concurrently constitutes the operating piston of the compensation volume element 69. The piston rod 66 of the pressure accumulator concurrently functions as a piston rod of the operating piston of the compensation volume element 69. This shared compensation volume element 69 is connected via a low-pressure line to the low-pressure side of the operating cylinder 7 and to the low-pressure side of the second control unit 61.

What is claimed is:

1. A hydraulic system comprising:

a reservoir for a hydraulic fluid;

a pump;

a high-pressure line network;

a low-pressure line network;

a first operating cylinder having a first operating piston and connectable to the high-pressure line network and the low-pressure line network via a first control unit;

a second operating cylinder having a second operating piston and connectable to the high-pressure line network and the low-pressure line network via a second control unit;

at least one local compensation volume element associated with a respective one of the first and second operating cylinders, the local compensation volume element adapted to compensate for a differential volume between a high-pressure side and a low pressure side of the respective first or second operating cylinder, and having a compensation space and a compensation operating piston disposed movably in the compensation space; and a mechanical connection coupled to the compensation operating piston and couplable to the respective one of the first and second operating pistons and configured to actuate the compensation volume element for accommodating and releasing the differential volume.

2. The hydraulic system as recited in claim 1, wherein the at least one local compensation volume element includes first and second local compensation volume elements, each associated with one of the first and second operating cylinders.

3. The hydraulic system as recited in claim 1, wherein the mechanical connection includes an elongated piston rod that extends from the respective one of the first or second operating cylinders and is connected to the respective compensation operating piston of the respective compensation volume element.

4. The hydraulic system as recited in claim 1, wherein the mechanical connection includes a piston rod of the first or second operating cylinder that concurrently constitutes a piston rod of the compensation operating piston of the compensation volume element.

5. The hydraulic system as recited in claim 4, wherein the local compensation volume element is disposed coaxially with at least one of the first and second operating cylinders with which it cooperates.

6. The hydraulic system as recited in claim 4, wherein the local compensation volume element is disposed on at least one of the first and second operating cylinders.

7. The hydraulic system as recited in claim 4, wherein the local compensation volume element is configured at least partially as a component of at least one of the first and second operating cylinders.

8. A hydraulic system comprising:

a reservoir for a hydraulic fluid;

a pump;

a high-pressure line network;

a low-pressure line network;

a first operating cylinder having a first operating piston and connectable to the high-pressure line network and the low-pressure line network via a first control unit;

a second operating cylinder having a second operating piston and connectable to the high-pressure line network and the low-pressure line network via a second control unit;

a pressure accumulator having an accumulator operating piston and a useful piston displacement greater than a piston displacement of the second operating cylinder a shared local compensation volume element associated with the second operating cylinder and adapted to accommodate differential volumes between a high-pressure side and a low pressure side of the second operating cylinder and of the pressure accumulator, the compensation volume element having a compensation space and a compensation operating piston disposed movably in the compensation space; and a mechanical connection coupled to the compensation operating piston, couplable to the accumulator operating piston and configured to actuate the compensation volume element for accommodating and releasing the differential volume.

9. The hydraulic system as recited in claim 8, wherein the shared compensation volume element forms a partial area of the pressure accumulator.

10. The hydraulic system as recited in claim 8, wherein the mechanical connection includes an elongated piston rod that extends from the pressure accumulator and is connected to the compensation operating piston of the compensation volume element.

11. The hydraulic system as recited in claim 8, wherein the mechanical connection includes a piston rod of the accumulator operating piston that concurrently constitutes a piston rod of the compensation operating piston of the compensation volume element.

12. The hydraulic system as recited in claim 8, wherein the local compensation volume element is disposed coaxially with the pressure accumulator.

13. The hydraulic system as recited in claim 8, wherein the local compensation volume element is disposed on the pressure accumulator.

14. The hydraulic system as recited in claim 8, wherein the local compensation volume element is configured at least partially as a component of the pressure accumulator.

* * * * *